US006138836A

United States Patent [19]

Valli

[11] Patent Number: 6,138,836

[45] Date of Patent: Oct. 31, 2000

[54] BLADE ARRANGEMENT FOR PULP SCREENING APPARATUS

[75] Inventor: Juhani Valli, Tampere, Finland

[73] Assignee: Valmet Corporation, Helsinki, Finland

[21] Appl. No.: 09/440,027

[22] Filed: Nov. 12, 1999

Related U.S. Application Data

[63] Continuation of application No. PCT/FI98/00426, May 20, 1998.

[30] Foreign Application Priority Data

May 21, 1997 [FI] Finland ..... 972163

[51] Int. Cl.[7] ..... B07B 1/06

[52] U.S. Cl. ..... 209/278; 209/276; 209/281; 209/283

[58] Field of Search ..... 209/273, 281, 209/283, 276, 278, 288, 293, 296, 303, 304, 305, 306, 17; 210/414, 415, 396; 162/55, 251

[56] References Cited

U.S. PATENT DOCUMENTS

| | | |
|---|---|---|
| 4,097,374 | 6/1978 | Young . |
| 4,111,799 | 9/1978 | Cancilla . |
| 5,000,842 | 3/1991 | Ljokkoi . |
| 5,611,434 | 3/1997 | Veh et al. . |

FOREIGN PATENT DOCUMENTS

| | | |
|---|---|---|
| 2186328 | 3/1997 | Canada . |

*Primary Examiner*—Tuan N. Nguyen
*Assistant Examiner*—Jonathan R. Miller
*Attorney, Agent, or Firm*—Alston & Bird LLP

[57] ABSTRACT

In the arrangement, the cross section of a blade rotating close to the surface of a screen cylinder changes in such a way that as the pulp consistency changes in the vertical direction of the screen cylinder, the cross section of the blade also changes in order to operate as efficiently as possible according to the pulp consistency by the blade.

9 Claims, 2 Drawing Sheets

FIG. 2a
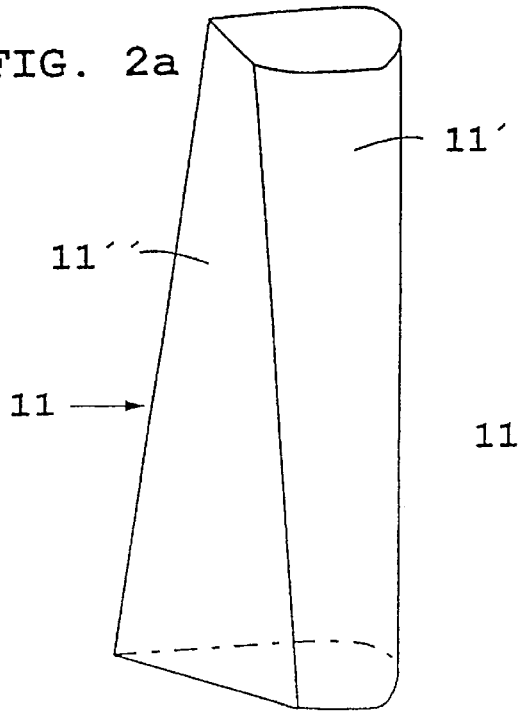
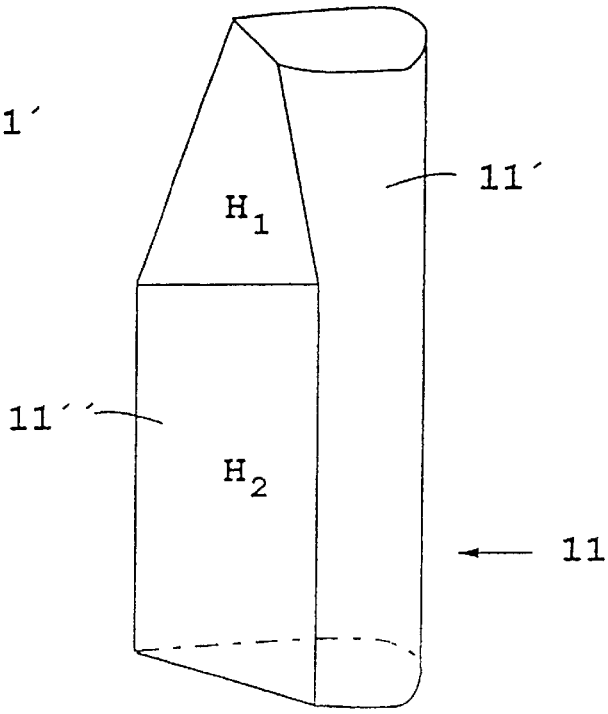
FIG. 3
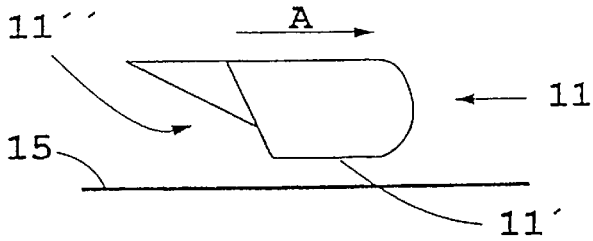
FIG .2b
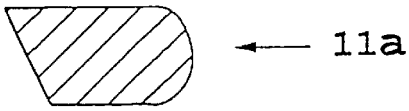
FIG. 5a
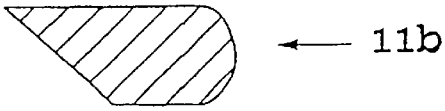
FIG. 5b
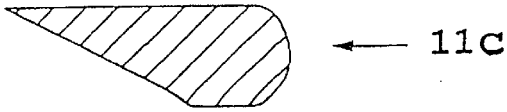
FIG. 5c

BLADE ARRANGEMENT FOR PULP SCREENING APPARATUS

CROSS-REFERENCE TO RELATED APPLICATION

This application is a continuation claiming priority under 35 U.S.C. § 365(c) of International Application No. PCT/FI98/00426 filed May 20, 1998 which claims the benefit of Finnish Application No. 972163 filed May 21, 1997.

FIELD OF THE INVENTION

The invention relates to a blade arrangement for a pulp screening apparatus comprising a screen cylinder provided with apertures, the pulp to be screened being fed to one surface of the screen cylinder, and blades that rotate round the axle of the screen cylinder close to the surface whereto the pulp to be screened is fed, and which blades comprise a portion that creates a pressure change for removing material that is clogged in the screen cylinder apertures, and in which screening apparatus the pulp is fed to the screen from one end and the rejected pulp fraction is discharged from the opposite end in the axial direction of the screen cylinder.

BACKGROUND OF THE INVENTION

When the pulp is screened, a pulp suspension composed of fibres and water is fed to a screen comprising a screen cylinder provided with apertures, such as openings or slits of different shapes, and blades inside the screen cylinder, the blades rotating round the axle of the screen cylinder along the inner surface of the cylinder. In some cases, depending on the way of feeding the pulp to the screen, there are also blades rotating along the outer surface of the screen cylinder. The purpose of the blades is to maintain the inner or, correspondingly, the outer surface of the screen cylinder clean of the material that is screened and, on the other hand, to detach the fibre material already accumulated on the surface to be carried further in the screening process. In some cases, instead of rotating blades, a rotating screen cylinder is used, whereby cleaning is accomplished by the movement of the surface of the screen cylinder past a stationary blade. Nowadays, various multi-stage screens are further used comprising several successive screen cylinders in the axial direction of the screen. For cleaning the surface of the screen cylinder, either a separate blade by each screen cylinder or a one-piece blade extending over the whole screening surface can also be used.

In the screen, the pulp is typically screened over the whole height of the screen, whereby part of the fibres and water flows through the openings of the screen cylinder. As the screening proceeds, i.e. as the pulp flows downwards in the vertical direction of the screen, more water penetrates the screen cylinder in proportion to the amount of water initially in the pulp suspension. A problem arises as a result of this, since as the pulp consistency increases, the accumulation of the fibres on the surface of the screen also increases, thus impairing the screen operation and permeability.

SUMMARY OF THE INVENTION

The object of the present invention is to provide such a blade arrangement by means of which a screen surface can be maintained clean over the whole height of a screen in the vertical direction more efficiently than before, thereby improving the screen operation and capacity. The blade arrangement of the invention is characterized in that in the blade arrangement, the cross section of the blade in the vertical direction of the screening apparatus changes according to the consistency of the pulp screened in such a way that the blade comprises on its trailing side a sloping section creating a suction pulse, that the sloping section is short and steep at the upper end of the screening apparatus where the consistency of the pulp screened is lower, and, correspondingly, at the lower end of the blade where the consistency of the pulp screened is higher, the sloping section creating the suction pulse is longer and slightly inclined.

It is an essential idea of the invention that when moving from the inlet end of the pulp towards the discharge end of the reject in the axial direction of the screen, the cross section of the blade, or the cross section of successive separate blade parts in the axial direction, changes in such a way that the effect of the cross section on the cleaning of the surfaces of the screen cylinder is as suitable as possible with regard to the pulp consistency by said point. This means that the cross section of the blade can suitably change either over its whole length, or, when successive blade parts are used, by preferably determining the cross section of each successive blade part with regard to the average consistency by the cross section. It is an advantage of the invention that the screening surface of the screen can be maintained clean preferably more efficiently than before since the effect of the suction pulse created by the sloping section of the trailing edge of the blade, or a part thereof, that moves close to each screening surface can be optimized on an average according to the pulp consistency by said screening surface. Furthermore, the solution of the invention is low-cost and easy to implement particularly in the solution where the cross section of each blade is unchanged but yet suitable with regard to the pulp consistency within its operating range. According to a preferred embodiment, as regards the operation and construction of the apparatus, there can exist in the vertical direction of the same screen even several successive blade parts whose cross section and position with regard to the surface of the screen cylinder is as suitable as possible. Manufacturing such blades with an unchanged cross section is easy and low cost, thus providing good efficiency at a relatively low-cost.

BRIEF DESCRIPTION OF THE DRAWINGS

The invention will be described in more detail in the accompanying drawings, in which FIG. 1 schematically shows a screen whereto the blade arrangement of the invention can be applied, FIGS. 2*a* and 2*b* schematically show a perspective top view of a blade profile that can be applied to the blade arrangement of the invention, FIG. 3 is a schematic perspective view of a second blade profile that can be applied to the implementation of the blade arrangement of the invention.

DETAILED DESCRIPTION OF THE PREFERRED EMBODIMENTS

Figure 1:
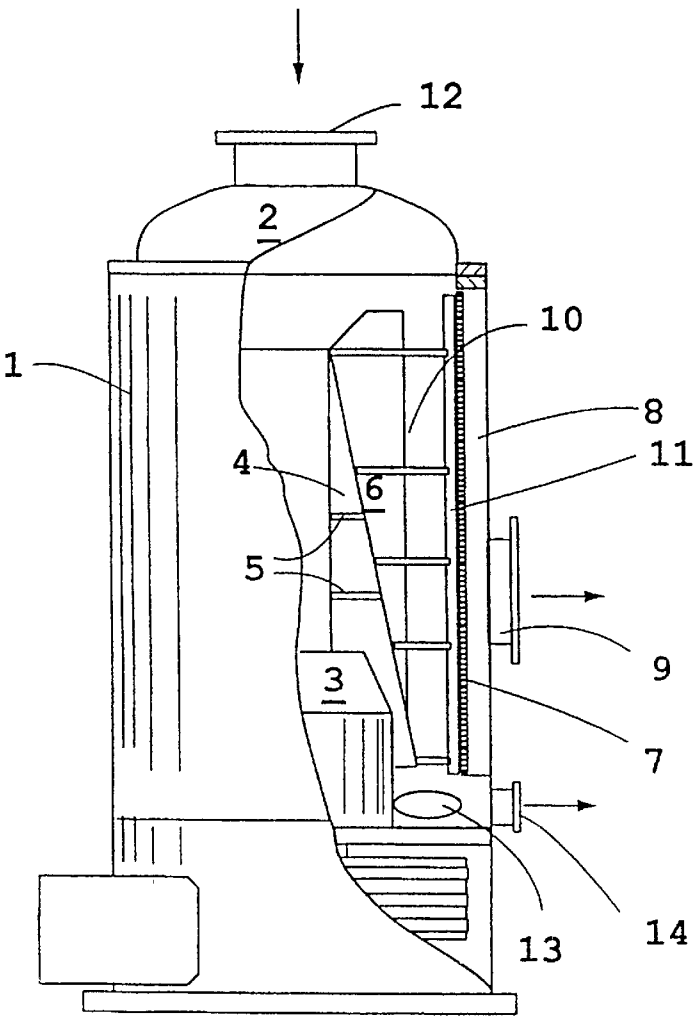

FIG. 1 schematically shows a screen that is suitable for pulp screening and whereto the blade arrangement of the invention can be applied.

The screen comprises a body containing a housing 1 with a cover 2. Inside the housing 1 is arranged coaxially therewith a rotating rotor 3, which is rotated in a manner known per se by a motor (not shown). A conical inner housing 4 is secured to the rotor 3 with rods 5. Furthermore, plate-formed blades 6 are secured to the rotor for making the pulp rotate inside the screen.

The screen comprises a screen cylinder 7 and outside thereof a ring-shaped exhaust chamber 8, an accept exhaust conduit 9 branching therefrom. Blades 11 are secured to the rotor 3 housing by rods 10 by the screen cylinder 7, the blades rotating along the inner surface of the screen cylinder 7 as the rotor 3 rotates in a manner known per se and detaches by means of pulses the material pressed against the inner surface of the screen cylinder 7. The pulp is fed to the upper part of the screen via an inlet conduit 12 in the cover 2 of the screen and the pulp flows in the case presented in the figure downwards along a downward narrowing ring-shaped space formed by the screen cylinder 7 and the inner housing 4. The pulp is screened by the screen cylinder 7 from where the pulp that has penetrated the screen enters the exhaust chamber 8 and is then discharged via the exhaust conduit 9. The pulp that does not penetrate the screen 7 flows downwards. After the screening, the remaining reject is discharged via the ring-shaped reject chamber 13 and the reject conduit 14 associated therewith and located below the screen cylinder 7.

As the pulp flows downwards in the vertical direction of the screen, its consistency changes, so that when for example pulp containing about 1% solid material consistency is fed to the upper part of the screen, the accepted pulp fraction discharged therefrom has a solid material consistency of about 0.6%. Consequently, since proportionally more water than pulp fibres penetrates the screen cylinder, the solid material consistency at the reject exhaust at the lower end of the screen is for example about 2.6%. These values vary according to the type of screen and pulp used, but the change in consistency in the screen typically takes place as described above. In accordance with the invention, the cross section of the blade 11 changes from the top downwards enabling the cross section of the upper section of the blade to operate efficiently in connection with more dilute pulp fed to the screen and, correspondingly, when moving downwards, the pulp consistency increases and the cross section of the blade changes in order to create a stronger suction pulse causing the material accumulated on the surface of the screen cylinder 7 to be moved farther away from the surface and thus clearing the openings on the surface of the screen cylinder more efficiently. Thus, as the pulp consistency increases and there is an increasing risk of the screen cylinder to become clogged, the cross section of the blade maintains the surface of the screen cylinder 7 clean more efficiently enabling the screening capability and capacity to be maintained good over the whole height of the screen.

FIGS. 2*a* and 2*b* show a perspective top view of a blade 11 that can be applied to the implementation of the blade arrangement of the invention. The cross section of the blade profile changes in the blade in such a way that in the upper section of the blade where the pulp consistency is lower, the section 11' on the screen cylinder surface 15 side is wider and, correspondingly, a sloping section 11" on the trailing side of the blade, i.e. the section disposed at the back with respect to the travel direction A, creating the suction pulse is steep and short. Correspondingly, at the lower end where the consistency is higher, the section 11' on the screen cylinder side is short and the sloping section 11" creating the suction pulse is long and slightly inclined in order to create a stronger suction pulse than the one at the upper end. In this case, the operating properties of the blade can be changed in the vertical direction of the screen cylinder, so that when the consistency changes, the surface of the screen cylinder can be maintained clean and the screening capability and capacity of the screen can be maintained good. The section of the edge (not visible) drawn by a dashed line schematically shows the shape of the lower end of the blade.

FIG. 3 shows a blade whose cross section changes discontinuously. In this implementation, the cross section of the upper section and, correspondingly, the lower section of the blade corresponds to that of the blade shown for example in FIGS. 2*a* and 2*b*. In this implementation, however, only the cross section of the upper section of the blade changes continuously at height $H_1$, and, correspondingly, the cross section of the lower section of the blade $H_2$ operating by the higher consistency is substantially unchanged. As regards the dimensions and cross sections, the operation of the blade has been designed according to the same principles as that of the blade shown in FIGS. 2*a* and 2*b*. Like in FIG. 2, a dashed line illustrating the edge (not visible) shows the shape of the lower end of the blade.

Figure 4:
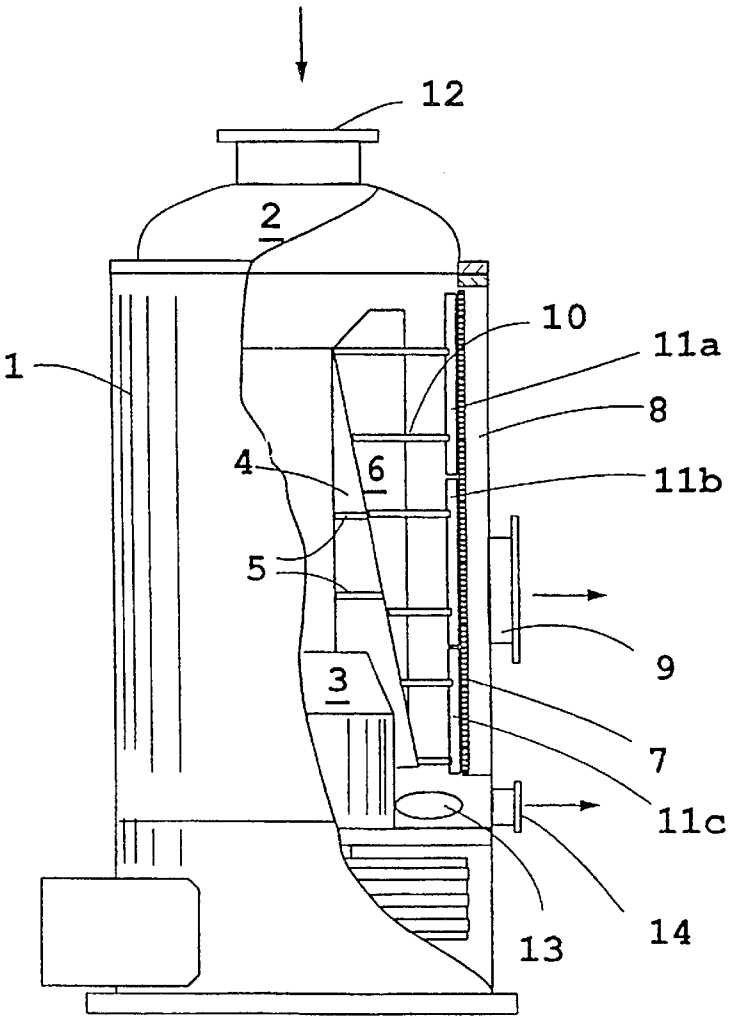
FIG. 4 is a partial schematic cross sectional view of the screen corresponding to that in FIG. 1, and FIGS. 5*a* to 5*c* show an embodiment of a blade arrangement of the invention that can be used in the manner presented in FIG. 4.

FIG. 4 is a partial schematic cross section of a screen corresponding to that in FIG. 1, and like numbers designate like parts. The difference in this implementation is that it comprises separate successive blades 11*a* to 11*c* maintaining said screen cylinder clean. In this implementation of a blade arrangement, a solution is employed wherein the cross section of each screen cylinder blade is either continuously changing as in FIG. 1 or, alternatively, the cross section of each blade is unchanged over its length, but the cross section of the successive blades changes in height.

FIGS. 5*a* to 5*c* show an implementation of a blade arrangement that can be applied as described in FIG. 4. The figures show how the cross sections of the screen blades 11*a* to 11*c* differ from one another. It can be detected that the cross section of the blade 11*a* shown in FIG. 5*a* corresponds in principle to the upper end of the blade 11 shown in FIGS. 2*a* and 2*b*. FIG. 5*b* in turn shows the cross section of a middle blade 11*b*, and it can be detected from the figure that it resembles the cross section in the middle of the blade shown in FIGS. 2*a* and 2*b*. Correspondingly, the cross section of the blade 11*c* presented in FIG. 5*c* substantially corresponds to the cross section of the lower end of the blade shown in FIGS. 2*a* and 2*b*. The cross section of the blade arrangement implemented in this manner changes in the vertical direction of the screen in such a way that each blade operates as well as possible according to the pulp consistency by each blade.

The invention has been described in the above description and drawings by way of example only, and it is not in any way restricted to it. It is essential in the blade arrangement that the cross section of the blade changes in the vertical direction of the screen in such a way that at the upper part of the screen, the cross section of the blade preferably operates in connection with diluted pulp entering the screen, and, correspondingly, at the lower end of the screen, the cross section of the blade operates efficiently in connection with more consistent pulp. Although the example describes a screen with blades rotating inside the screen cylinder, it is obvious to those skilled in the art that the blades can also be arranged to rotate outside the cylinder in a corresponding manner, in which case the pulp to be screened is fed to the outer surface of the screen cylinder. In that case, when the cross section of the blades is designed, precisely the same principle is applied as is presented in the examples illustrating the blades designed to rotate along the inner surface of the screen cylinder according to the manner of the invention.

What is claimed is:

1. A blade arrangement for a pulp screening apparatus comprising a screen cylinder (7) provided with apertures, the pulp to be screened being fed to one surface of the screen cylinder, and blades (11; 11*a* to 11*c*) that rotate round the axle of the screen cylinder (7) close to the surface whereto the pulp to be screened is fed, and which blades (11; 11*a* to 11*c*) comprise a portion that creates a pressure change for removing material that is clogged in the screen cylinder (7) apertures, and in which screening apparatus the pulp is fed to the screen from one end and the rejected pulp fraction is discharged from the opposite end in the axial direction of the screen cylinder, characterized in that in the blade arrangement, the cross section of the blade (11; 11*a* to 11*c*) in the vertical direction of the screening apparatus changes according to the consistency of the pulp screened in such a way that the blade comprises on its trailing side a sloping section (11") creating a suction pulse, that the sloping section (11") is short and steep at the upper end of the screening apparatus where the consistency of the pulp screened is lower, and, correspondingly, at the lower end of the blade where the consistency of the pulp screened is higher, the sloping section (11") creating the suction pulse is longer and slightly inclined.

2. A blade arrangement as claimed in claim 1, characterized in that the cross section of the blade changes substantially continuously over the whole length of the blade.

3. A blade arrangement as claimed in claim 1, characterized in that the cross section of the blade changes in sections.

4. A blade arrangement as claimed in claim 3, characterized in that the cross section of the blade changes in sections in such a way that the longitudinal cross section of one blade is substantially unchanged, and the longitudinal cross section of the next blade differs from the former.

5. A blade arrangement as claimed in claim 4, characterized in that each blade length having a cross section of the same shape is a separate blade part, whereby the blade parts with different cross sections are arranged at successive points in the axial direction of the screen cylinder (7) in the vertical direction of the screen.

6. A blade arrangement as claimed in claim 3, characterized in that the cross section of a first part of the blade length changes substantially continuously and that the cross section of a second part of the blade length is substantially unchanged.

7. A blade arrangement as claimed in any one of claims 1 to 4, characterized in that at least some of the blades are one-piece blades substantially extending over the length in the axial direction of the screen cylinder.

8. A blade arrangement as claimed in claim 5, characterized in that blade parts with different cross sections are arranged substantially in succession in the axial direction of the screen cylinder (7).

9. A blade arrangement as claimed in claim 5, characterized in that at least one of the blade parts (11*a* to 11*c*) is arranged at a different point with regard to the other blade parts in the direction of the screen cylinder (7) circumference.

* * * * *